US006364610B1

(12) United States Patent
Müller

(10) Patent No.: US 6,364,610 B1
(45) Date of Patent: Apr. 2, 2002

(54) MANUALLY ADJUSTABLE VARIABLE-PITCH BOAT PROPELLER

(75) Inventor: Peter Müller, Adliswil (CH)

(73) Assignee: Nasyc Holding S.A., Luxembourg (LU)

( * ) Notice: Subject to any disclaimer, the term of this patent is extended or adjusted under 35 U.S.C. 154(b) by 0 days.

(21) Appl. No.: 09/632,660

(22) Filed: Aug. 4, 2000

(30) Foreign Application Priority Data

Aug. 5, 1999 (DE) ..... 199 36 951

(51) Int. Cl.[7] ..... B63H 1/06

(52) U.S. Cl. ..... 416/153; 416/147; 416/167; 416/165; 416/205

(58) Field of Search ..... 416/147, 153, 416/164, 165, 167, 205, 206, 209; 440/50

(56) References Cited

U.S. PATENT DOCUMENTS

| | | | | |
|---|---|---|---|---|
| 2,953,208 A | * | 9/1960 | O'Connor | 416/147 |
| 4,897,056 A | | 1/1990 | Müller | |
| 5,232,345 A | | 8/1993 | Rocco | |
| 5,967,753 A | * | 10/1999 | Muller | 416/167 |

FOREIGN PATENT DOCUMENTS

| | | |
|---|---|---|
| EP | 0297162 | 1/1989 |
| EP | 0300252 | 1/1989 |

OTHER PUBLICATIONS

*Rudder* May 1969, p. 79.

* cited by examiner

*Primary Examiner*—Christopher Verdier
(74) *Attorney, Agent, or Firm*—Herbert Dubno; Andrew Wilford

(57) ABSTRACT

A variable-pitch boat propeller has a hub rotatable about a hub axis, a plurality of vanes rotatable on the hub and extending generally radially of the hub axis, and an adjustment element rotatable on the hub about the hub axis and connected to the vanes for pivoting the vanes on the hub. An adjustment knob is pivotal on the hub about the hub axis and interengaging formations on the knob and hub limit angular displacement of the knob on the hub between a pair of end positions so that a limited range of adjustment of the vanes is possible with the knob. The interengaging formations include an axially open groove having a pair of ends constituting abutments and an axially projecting screw head and rotationally fixed relative to the hub and received in the groove. The groove is formed in the knob and the screw head is carried on a yoke rotationally coupled to the hub. The groove is arcuate, centered on the hub axis, and has an arc length of substantially less than 360°.

9 Claims, 3 Drawing Sheets

MANUALLY ADJUSTABLE VARIABLE-PITCH BOAT PROPELLER

FIELD OF THE INVENTION

The present invention relates to a boat propeller. More particularly this invention concerns a variable-pitch boat propeller whose vanes can be set manually.

BACKGROUND OF THE INVENTION

A standard variable-pitch boat propeller as described in my U.S. Pat. No. 4,897,056 has a hub shaft that is rotated by the boat's engine about a hub axis and that carries a plurality of vanes extending radially of the hub axis and pivotal about respective vane axes extending generally radially of the hub axis. An adjustment element on the hub is axially displaceable and is coupled via respective eccentric mechanisms to the vanes so that, as the adjustment element is shifted axially, the vanes all pivot synchronously about their respective axes. In this manner the pitch of the vanes can be changed for different drive characteristics. The adjustment element is typically mounted via a screwthread on the hub so that as it it rotated it moves axially and changes the vane setting.

In the standard system a knob is mounted on or actually formed as part of the adjustment element. In order to ensure that the vane settings do not drift, the knob is set to lock on the hub except when it is pulled back against a spring force. The boat operator can therefore pull the knob back and rotate it to change the vane setting.

This system provides a wide range of variation of settings for the propeller vanes. In practice, however, the propeller is normally used in only two different positions. For instance a boater who periodically pulls water skiers will have a normal-travel setting and a water-ski setting. Finding these settings, even if there are indicia on the drive, is difficult, normally requiring that the drive be lifted. Under the best of circumstances, finding a particular setting is difficult.

OBJECTS OF THE INVENTION

It is therefore an object of the present invention to provide an improved variable-pitch boat propeller.

Another object is the provision of such an improved variable-pitch boat propeller which overcomes the above-given disadvantages, that is which can easily be switched between different settings.

SUMMARY OF THE INVENTION

A variable-pitch boat propeller has according to the invention a hub rotatable about a hub axis, a plurality of vanes rotatable on the hub and extending generally radially of the hub axis, and an adjustment element rotatable on the hub about the hub axis and connected to the vanes for pivoting the vanes on the hub. An adjustment knob is pivotal on the hub about the hub axis and interengaging formations on the knob and hub limit angular displacement of the knob on the hub between a pair of end positions so that a limited range of adjustment of the vanes is possible with the knob.

Thus with this system the sleeve is positioned such that, once the knob is in place, it can be easily shifted between a pair of predetermined positions. Thus the sleeve is normally set in the shop for an ideal normal-travel direction and the knob is fitted in place so that the sleeve can be rotated out of this preset position through, say, 100° to another position ideal for water skiing, for example. The user of the boat can merely shift the knob between end positions to get the only two vane positions that are normally needed. Of course if the knob is removed and reset in another position, the end positions can be changed.

The propeller further has according to the invention at least one fastener releasably fixing the knob against axial movement on the adjustment element. This fastener is a screw extending radially of the hub axis in the knob. The adjustment element is formed with a groove open radially outward relative to the hub axis and receiving an inner end of the screw. Removal of this screw allows the knob, which is typically splined to the adjustment element, to be removed and reset with ease.

The interengaging formations include an axially open groove having a pair of ends constituting abutments and an axially projecting screw head and rotationally fixed relative to the hub and received in the groove. The groove is formed in the knob and the screw head is carried on a yoke rotationally coupled to the hub. The groove is arcuate, centered on the hub axis, and has an arc length of substantially less than 360°.

A ratchet mechanism operatively engaged between the hub and the adjustment element releasably retains same against relative angular movement in a plurality of angularly offset positions. The adjustment mechanism includes a yoke axially displaceable but rotationally fixed on the hub. The ratchet is an axially spring-biased element angularly fixed on the yoke and a plurality of axially open seats receiving the element and formed on the adjustment element.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
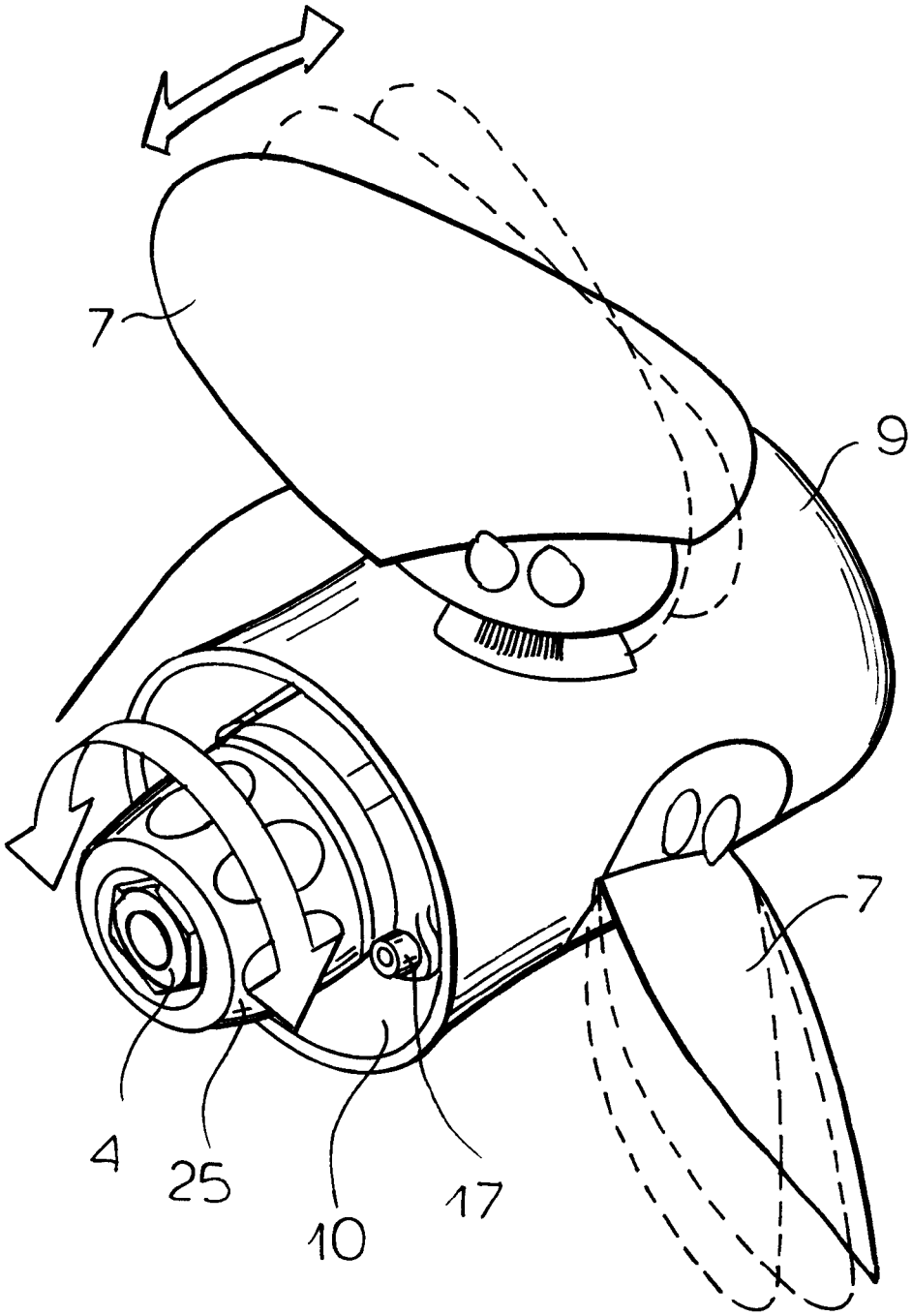
FIG. 1 is a small-scale perspective view of the propeller according to the invention.

As seen in the drawings, a variable-pitch boat propeller has a tubular central hub shaft 1 centered on a hub axis A and having a front end fitted over an engine drive shaft 2 in turn having a threaded rear end 3 engaged by a tubular nut 4 that holds the hub shaft 1 solidly on the shaft 2. Three vane subassemblies 5 each comprise a base plate 6 pivotal a respective radial vane axis A' and carrying a respective outwardly projecting vane 7. The hub shaft 1 has an outer housing part 8 carrying a jacket 9 defining axially through-going openings 10 allowing exhaust to be vented under water through the propeller.

Each vane 7 is controlled by a respective setting rod 11 extending parallel to the hub axis A in a bore 12 of the hub shaft 1. Each rod 11 carries a pin 13 extending parallel to the respective axis A' and seated in a slot 14 of the respective vane plate 6 so that axial movement of the rod 11 pivots the vane 7 about its axis A' as described in above-cited U.S. Pat. No. 4,897,056.

The front end of each rod 11 is connected to a respective cuff-like seal 15 whose interior is vented through a hole 16. The rear end of each rod 11 is secured by a respective screw 17 to a yoke 18 fitting around the rear end of the hub shaft 1 and rotationally fixed thereon by its attachment to the rods 11. Engaged between the yoke 18 and the hub shaft 1 is an adjustment sleeve 19 having an internal screwthread 20 meshing with an external thread 21 of the rear end of the hub shaft 1 and having a radially projecting flange 22 captured by a nut 24 threaded at 23 in the yoke 18. Thus the adjustment sleeve 19 and yoke 18 are axially fixed relative to each other but the sleeve 19 can still rotate relative to the hub shaft 1 and yoke 18. As a result of the interengaging screwthreads 20 and 21, such relative rotation of the yoke 18 and sleeve 18 moves the yoke 18 relative to the hub shaft 1, thereby pivoting the vanes 7 jointly and identically about their axes A'.

An adjustment knob 25 fits over the rear end of the sleeve 19 and hub shaft 1 and is rotationally coupled by axially extending splines 26 to the sleeve 19. A mounting screw 27 threaded into the knob 25 extends radially of the axis A and has an inner end engaged in a radially outwardly open groove 28 of the sleeve 19 to axially fix the knob 25 on the sleeve 19.

The knob 25 is formed with an arcuate groove 29 opening axially forwardly relative to the axis A and the yoke 18 carries a screw 30 whose head is engaged in this groove 29. The front end of this axially extending screw 30 bears on a spring 33 in turn bearing on a ratchet element or ball 34 engaging in rearwardly open seats or notches 35 of the sleeve flange 22 so as to define a plurality of angularly offset stable positions for the knob 25 and sleeve 19 on the yoke 18 and hub shaft 1.

Figure 2:
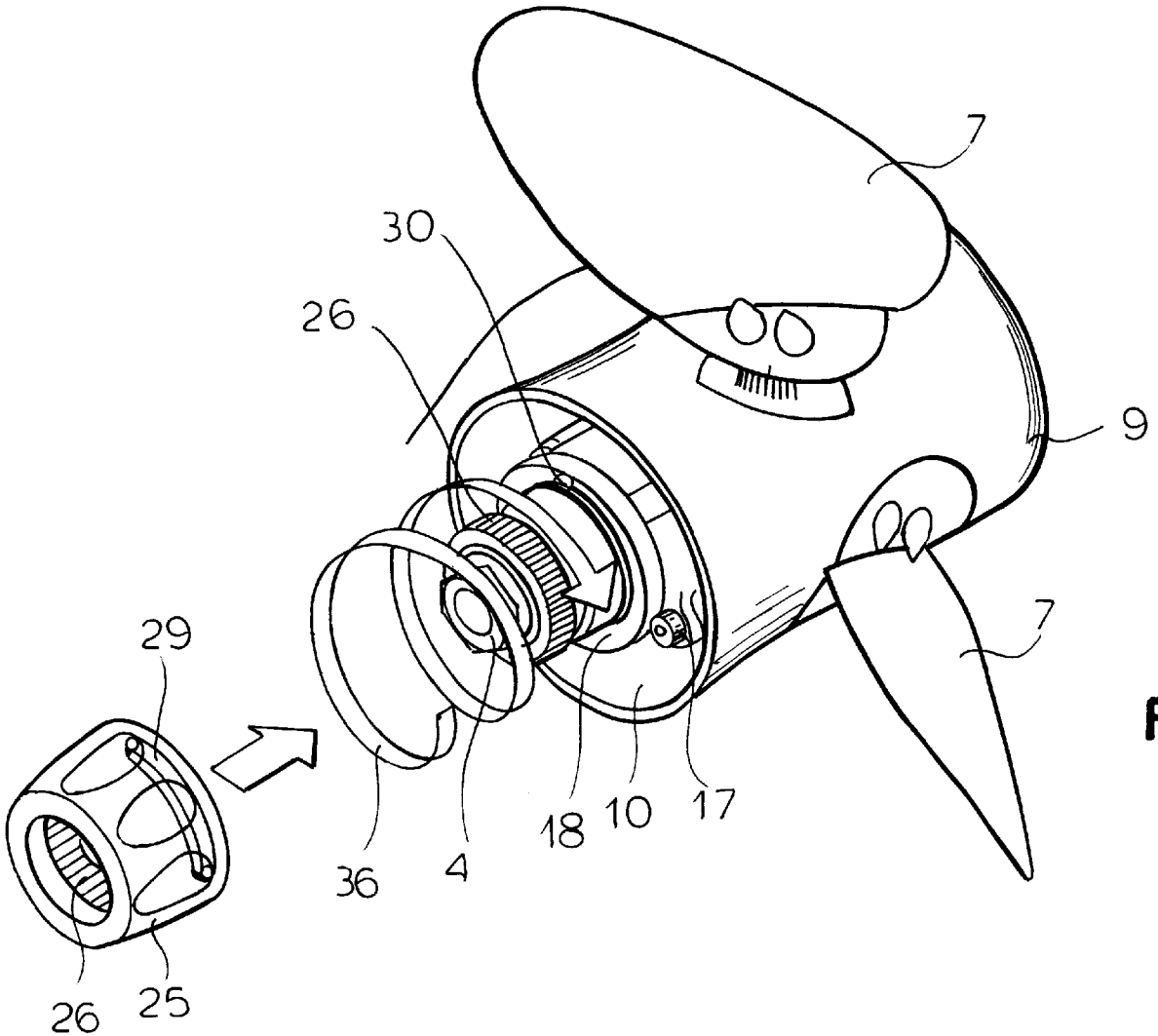
FIG. 2 is a view like FIG. 1 but with the manual adjustment knob removed for clarity of view.
Figure 3:
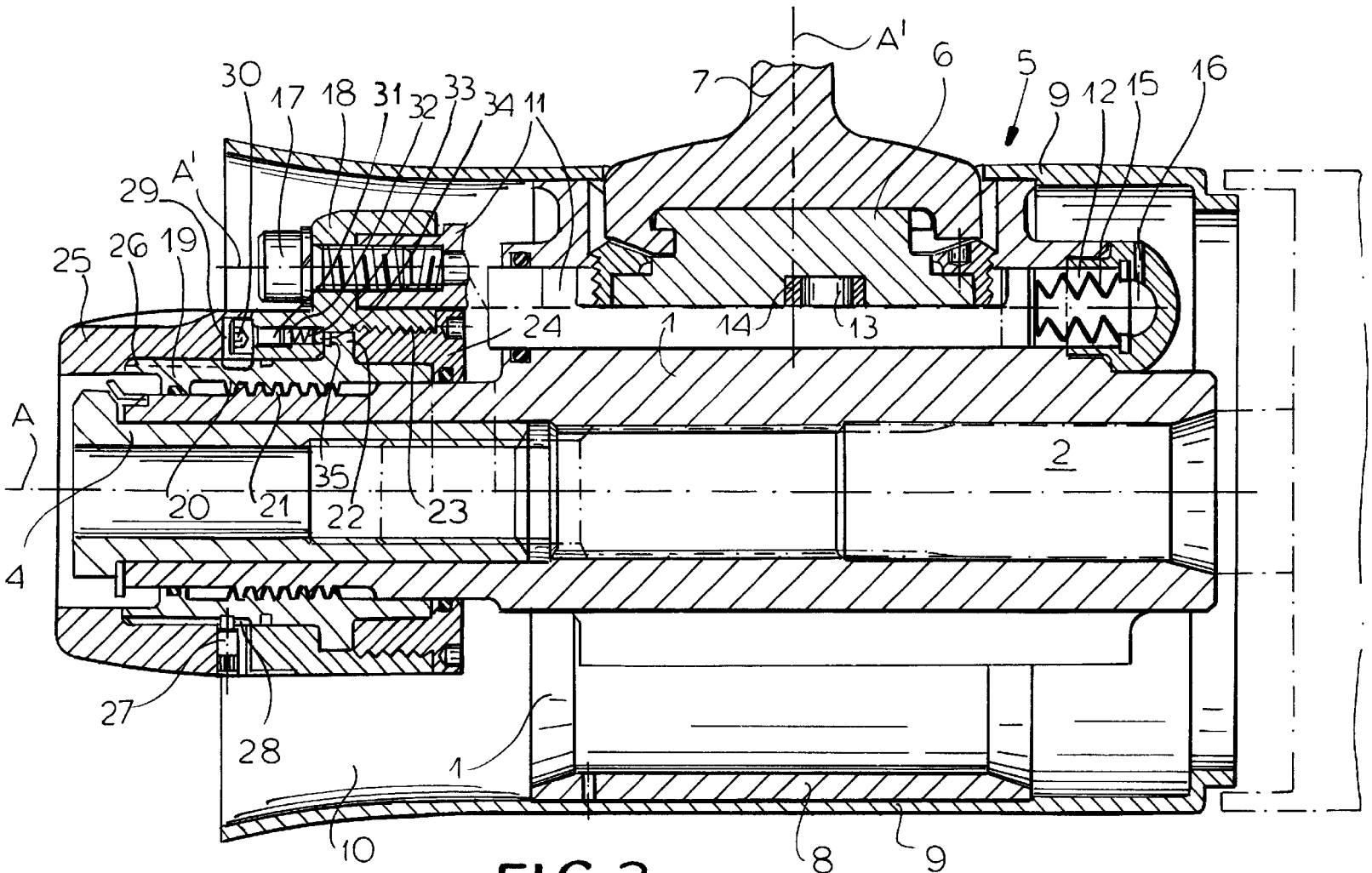
FIG. 3 is an axial section through the propeller.

When the knob 25 is not in place, the sleeve 19 can be rotated as shown by arrow 36 in FIG. 2 through several rotations for a very wide range of adjustment of the angular positions of the vanes 7. When the knob 25 is in place with the screw head 30 acting as an abutment fitting in the slot 29, the rotation is limited to substantially less than 360°, substantially limiting the range of adjustment of the vanes 7.

Thus with this system the knob 25 is only installed when the vanes 7 have been set in what is considered an acceptable position from which it can be varied limitedly in one direction or the other. Normally it is carefully set in the shop for the normal-travel position and the knob 25 is set in place with the screw head 30 at one end of the groove 29. When the knob 25 is then turned to set the screw head 30 in the opposite end of the groove 29, the vanes 7 are set for the optimum water-ski position. Thus the user need not have to resort to reading difficult settings off the propeller, but need merely move the knob 25 from one end position to the other to change the vanes 7 between these two standard positions, something that is easily done even with the drive under water. On the other hand the range within which adjustment is possible with the knob 25 is easily changed by removing the knob 25, rotating the sleeve 19 manually, and reinstalling the knob 25. Similarly replacement of the screw 30 with a headless screw, for instance an Allen screw, restores the full range of adjustability with the knob 25.

I claim:

1. A variable-pitch boat propeller comprising:

a hub rotatable about a hub axis;

a plurality of vanes rotatable on the hub and extending generally radially of the hub axis;

adjustment means including an adjustment element rotatable on the hub about the hub axis and connected to the vanes for pivoting the vanes on the hub;

an adjustment knob pivotal on the hub about the hub axis; and means including interengaging formations on the knob and hub for limiting angular displacement of the knob on the hub between a pair of end positions, whereby a limited range of adjustment of the vanes is possible with the knob.

2. The variable-pitch boat propeller defined in claim 1, further comprising means including at least one fastener releasably fixing the knob against axial movement on the adjustment element.

3. The variable-pitch boat propeller defined in claim 2 wherein the fastener is a screw extending radially of the hub axis in the knob, the adjustment element being formed with a groove open radially outward relative to the hub axis and receiving an inner end of the screw.

4. The variable-pitch boat propeller defined in claim 1 wherein the interengaging formations include an axially open groove having a pair of ends constituting abutments.

5. The variable-pitch boat propeller defined in claim 4 wherein the interengaging formations include an axially projecting screw head rotationally fixed relative to the hub and received in the groove.

6. The variable-pitch boat propeller defined in claim 5 wherein the groove is formed in the knob.

7. The variable-pitch boat propeller defined in claim 4 wherein the groove is arcuate, centered on the hub axis, and has an arc length of substantially less than 360°.

8. The variable-pitch boat propeller defined in claim 1, further comprising ratchet means operatively engaged between the hub and the adjustment element for releasably retaining the adjusting element against relative angular movement in a plurality of angularly offset positions.

9. The variable-pitch boat propeller defined in claim 8 wherein the adjustment means includes a yoke axially displaceable but rotationally fixed on the hub, the ratchet means including an axially spring-biased element angularly fixed on the yoke and a plurality of axially open seats receiving the spring element and formed on the adjustment element.

* * * * *